US007950878B2

(12) United States Patent
Carpenter

(10) Patent No.: US 7,950,878 B2
(45) **Date of Patent: *May 31, 2011**

(54) SHORELINE EROSION CONTROL SYSTEM

(75) Inventor: Thomas J. Carpenter, Ankeny, IA (US)

(73) Assignee: Erosion Tech, LLC, Ankeny, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/715,904

(22) Filed: Mar. 2, 2010

(65) Prior Publication Data

US 2010/0178108 A1 Jul. 15, 2010

Related U.S. Application Data

(63) Continuation of application No. 12/214,346, filed on Jun. 18, 2008, now Pat. No. 7,695,219.

(51) Int. Cl.
*E02B 3/12* (2006.01)

(52) U.S. Cl. ..... 405/302.6; 405/302.7; 405/16; 405/17

(58) Field of Classification Search ..... 405/302.7, 405/302.6, 15, 16, 17, 19
See application file for complete search history.

(56) References Cited

U.S. PATENT DOCUMENTS

| | | | | | |
|---|---|---|---|---|---|
| 360,225 | A * | 3/1887 | Kanters | 405/19 |
| 3,570,254 | A * | 3/1971 | Turzillo | 405/18 |
| 4,596,731 | A * | 6/1986 | Cudmore et al. | 428/134 |
| 4,610,568 | A * | 9/1986 | Koerner | 405/19 |
| 5,171,108 | A * | 12/1992 | Hugron | 405/259.1 |
| 5,256,007 | A * | 10/1993 | Allen | 405/302.4 |
| 5,364,206 | A * | 11/1994 | Marienfeld | 405/302.6 |
| 5,476,339 | A * | 12/1995 | Baranowski | 404/36 |
| 5,584,600 | A * | 12/1996 | Langdon | 405/16 |
| 5,820,294 | A * | 10/1998 | Baranowski | 404/36 |
| 5,951,202 | A * | 9/1999 | Brown | 405/19 |
| 6,592,292 | B1 * | 7/2003 | Jansson | 405/16 |
| 6,951,438 | B2 * | 10/2005 | Carpenter | 405/302.6 |
| 7,033,109 | B2 * | 4/2006 | Russell et al. | 405/259.1 |
| 7,695,219 | B2 * | 4/2010 | Carpenter | 405/302.6 |
| 2003/0017000 | A1 * | 1/2003 | Jansson | 405/16 |
| 2003/0082015 | A1 * | 5/2003 | Christensen | 405/302.6 |
| 2003/0228192 | A1 * | 12/2003 | Jansson | 405/16 |

OTHER PUBLICATIONS

Final Office Action; Mail Date: Sep. 8, 2009; U.S. Appl. No. 11/500,811, filed Aug. 8, 2006; 8 pages.
Non-final Office Action; Mail Date: Nov. 24, 2009; U.S. Appl. No. 11/500,811, filed Aug. 8, 2006; 9 pages.
Non-final Office Action; Mail Date: Dec. 5, 2008; U.S. Appl. No. 11/500,811, filed Aug. 8, 2006; 8 pages.
Non-final Office Action; Mail Date: Jun. 11, 2009; U.S. Appl. No. 11/827,639, filed Jul. 12, 2007: 15 pages.
Non-final Office Action; Mail Date: Feb. 20, 2010; U.S. Appl. No. 11/827,639, filed Jul. 12, 2007; 5 pages.
Final Office Action, Mail Date: Jun. 8, 2010; U.S. Appl. No. 11/500,811, filed Aug. 8, 2006; 8 pages.

(Continued)

*Primary Examiner* — Frederick L Lagman
(74) *Attorney, Agent, or Firm* — Shook, Hardy & Bacon LLP

(57) ABSTRACT

An erosion control system for reducing shoreline erosion resulting from wave action, runoff and hydrostatic pressure. The system includes a flexible geotextile provided over a shoreline. A plurality of rigid erosion control mats are provided over the flexible geotextile and secured in place by a plurality of anchors secured into the shoreline. The geotextile, erosion control mat and anchors may be adjusted to accommodate shorelines of varying slopes and susceptibility to erosion.

5 Claims, 6 Drawing Sheets

OTHER PUBLICATIONS

Notice of Allowance; Mail Date: Jun. 11, 2010; U.S. Appl. No. 11/827,639, filed Jul. 12, 2007; 11 pages.

Notice of Allowance, U.S. Appl. No. 11/500,811, date mailed: Aug. 24, 2010.

* cited by examiner

SHORELINE EROSION CONTROL SYSTEM

CROSS-REFERENCE TO RELATED APPLICATIONS

This application is a continuation of co-pending U.S. patent application Ser. No. 12/214,346, filed Jun. 18, 2008, the disclosure of which is hereby incorporated by reference herein in its entirety.

FIELD OF THE INVENTION

The present invention relates in general to an erosion control system for reducing erosion and, more particularly, to a system for reducing shoreline erosion.

BACKGROUND

Property located adjacent bodies of water is particularly desirable. One problem associated with shoreline property, however, is the tendency of the body of water to erode the shoreline. If not addressed, over time, a substantial amount of property may be lost. Additionally, shoreline erosion can reduce animal habitats, increase turbidity and add much undesired sediment to the water. If the shoreline includes elements such as nitrogen and phosphorus, shoreline erosion can lead to an increase in algae and noxious plants.

While techniques are known in the art for reducing shoreline erosion, all such techniques have certain drawbacks. Woven mats, called turf reinforcement mats, are often provided over areas susceptible to erosion. The mats are typically large flexible mats constructed of plastic webbing. The open weave of the webbing allows for the growth of vegetation between the woven fibers of the mats, locking the mats in place and mechanically reducing energy associated with runoff water. The combination of the mechanical stable structure and open weave design results in a significant synergistic effect, with the capacity to carry much greater velocity and sheer force load because roots and stems associated with the upgrowing vegetation are reinforced by the mat. While turf reinforcement mats convey large flows of water and withstand designated loads in non-shoreline applications, the force of constant wave motion, especially in sloped applications, may cause turf reinforcement mats to fail, especially prior to vegetation growing through and locking the mats in place. It would, therefore, be desirable to provide a system for reducing shoreline erosion that provided a high degree of shoreline erosion control immediately, even before vegetation has a chance to assist in the erosion control process.

It is also known in the art to provide stacks of large rocks or "rip rap" over smaller rocks which are, in turn, placed over a shoreline geotextile layer. The smaller rocks act as a drainage layer, enabling water to flow back into the body of water with less erosive force. While rip rap is indeed effective at reducing erosion, it can be unsightly. Additionally, a significant weight and volume of material must be freighted to the site and a large amount of preparatory work is typically required before installing rip rap. Moreover, in steep applications, rip rap tends to roll into the water over time and must be continually replaced. Rip rap also may damage watercraft contacting the rocks, or being dashed against the rocks by waves after the watercraft has been moored. It would, therefore, be desirable to provide a lightweight system for controlling shoreline erosion which requires less costly and time-consuming maintenance.

Like riprap, articulated concrete blocks (ACB) can be used to reduce erosion. Although ACB may allow for the use of less material, the weight of ACB is still substantial, increasing transportation and installation costs. Additionally, ACB can be unaesthetic in appearance. ACB may also damage watercraft coming into contact with the ACB. It would, therefore, be desirable to provide a lightweight system for controlling shoreline erosion which is more aesthetically appealing and presents less of a hazard to watercraft.

Wetlands may also be employed to buffer a shoreline against storms and to physically hold the soil in place. Wetlands require a large "buffer zone" between the land and the water, and may often require a substantial amount of time before they have reached maximum erosion control efficacy. Wetlands are not particularly well suited for private property shorelines experiencing large amounts of human traffic and/or watercraft mooring. Wetlands and other types of vegetative armor are also not well suited to steeply sloped shorelines where it may be difficult to prevent runoff and wave action from washing the vegetation away. It would, therefore, be desirable to provide a shoreline erosion control system which is immediately effective and which does not require a large amount of buffer between the shore and the water to be effective.

Other physical barriers, constructed of wood, concrete or the like are known to reduce erosion even in steeply sloped areas. Such structures, however, are often expensive, and time consuming to construct, often requiring a caisson or similar structure to be built before construction can begin on the actual structure itself. Such structures are also costly and time consuming to maintain, and can be unaesthetically appealing. The high costs of labor and materials associated with such erosion abatement systems, often makes them undesirable from an economic standpoint. It would, therefore, be desirable to provide a shoreline erosion control system which is of a low cost manufacture and is quick and easy to install.

It would be desirable to provide a system and method for reducing shoreline erosion which is of a low-cost, lightweight manufacture. It would also be desirable that such a system and method be easy to install and maintain. Such a system and method would also preferably be aesthetically pleasing and not pose a threat of serious damages to watercraft. The difficulties encountered in the prior art discussed hereinabove are substantially eliminated by the present invention.

SUMMARY

In an advantage provided by this invention, a shoreline erosion control system is provided which is of a lightweight, low cost manufacture.

Advantageously, this invention provides a shoreline erosion control system which is easy to install.

Advantageously, this invention provides a shoreline erosion control system which supports shoreline habitat.

Advantageously, this invention provides a shoreline erosion control system which decreases water turbidity and reduces sediment in the water.

Advantageously, this invention provides a shoreline erosion system which holds soil particles in place against different water pressures created by inflow and outflow of water associated with wave energy.

Advantageously, this invention provides a shoreline erosion control system which is easy to remove.

Advantageously, this invention provides a shoreline erosion control system which reduces damage to watercraft along the shoreline.

Advantageously, this invention provides a shoreline erosion control system which is easy to maintain.

Advantageously, this invention provides a shoreline erosion control system which allows for quick installation without heavy or costly tools.

Advantageously, this invention provides a shoreline erosion control system which allows greater securement with fewer securement points.

Advantageously, this invention provides for maintaining a shoreline erosion control system in place against wave action.

Advantageously, in a preferred example of this invention, a shoreline erosion control system is provided. The shoreline erosion control system includes a fabric positioned over at least a portion of the shoreline. An erosion control mat comprising a surface defining a plurality of holes is positioned at least partially over the fabric. An anchor is used to secure the erosion control mat and the fabric to the soil structure.

DESCRIPTION OF THE DRAWINGS

The present invention will now be described, by way of example, with reference to the accompanying drawings in which.

DETAILED DESCRIPTION

Figure 1:
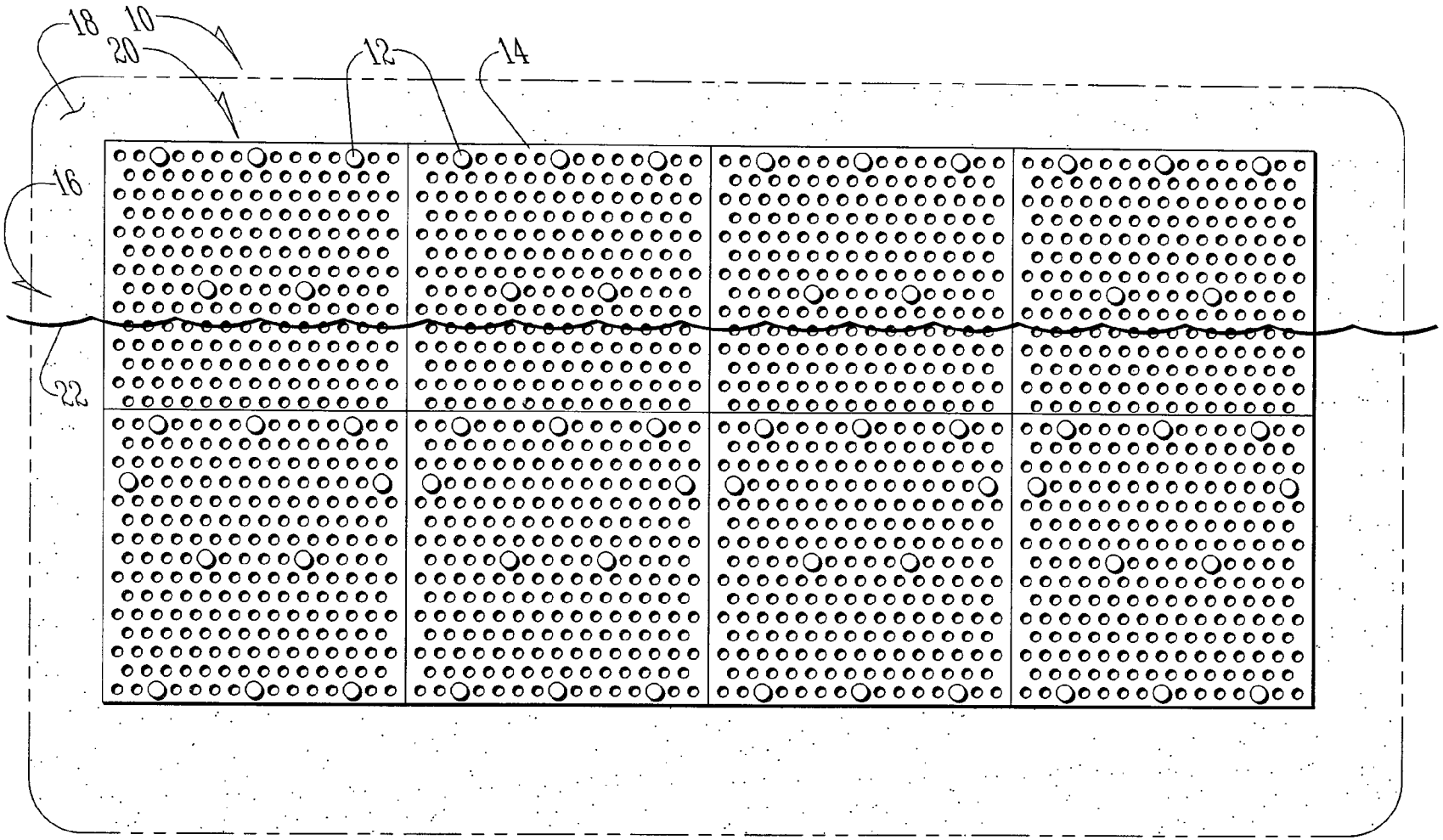
FIG. 1 illustrates a top plan view of a plurality of erosion control mats secured into an erosion control mat structure over a flexible erosion control surface and a shoreline.

A shoreline erosion control system according to this invention is shown generally as (10) in FIG. 1. Anchor systems (12) are shown securing a plurality of erosion control mats (14) to a shoreline (16). The erosion control mats (14) are preferably of a type described in U.S. Pat. No. 6,951,438, which is incorporated herein by this reference. The erosion control mats (14) are preferably provided over a flexible erosion control surface (18). The erosion control surface (18) may extend beyond the edges of the erosion control mats (14) as shown in FIG. 1, or may only extend under a portion of the erosion control mats (14).

The flexible erosion control surface (18) is preferably a geotextile fabric. The geotextile may be any permeable textile material known in the art to increase soil stability, provide erosion control or aid in drainage. In the preferred embodiment, the geotextile is a non woven slit film synthetic polymer such as polypropylene, polyester, polyethylene or polyamide. Alternatively, the geotextiles may be woven, knitted or non-woven if more filtration is desired. If desired, the erosion control surface (18) may be constructed of plastic sheeting, canvas, sod, a turf reinforcement mat, or any other flexible erosion control surface. The flexible erosion control surface (1 8) is preferably sufficiently flexible to be rolled onto itself without permanent deformation.

The anchor systems (12) are used to secure the erosion control mats (14) in a laterally adjacent and/or overlapped relationship. In the preferred embodiment, the erosion control mats (14) are secured adjacent one another, with less than two thirds of the resulting erosion control mat structure (20) positioned above the waterline (22), more preferably less than half of the erosion control mat structure (20) positioned above the waterline (22) and most preferably less than one third of the erosion control mat structure (20) positioned above the waterline (22). If desired, the erosion control mat structure (20) may be completely submerged. The erosion control mat (14) may be constructed in any desired material, but is preferably semi-rigid and resilient, allowing slight deformation, but returning to its original shape.

The erosion control mat (14) may be constructed of polyvinyl chloride or any desired material, and is preferably sufficiently inflexible so as to be incapable of being rolled onto itself without permanent deformation.

In the preferred embodiment, a two meter long and one meter wide section of the material used to construct the erosion control mat (14) deflects less than forty-five degrees when supported by one end. The erosion control mat (14) is provided with holes (30) having a diameter of preferably less than ten centimeters and, more preferably, less than five centimeters. The erosion control mat (14) is less than one hundred square meters, preferably less than five square meters and, most preferably about one square meter in area. The erosion control mat (14) weighs less than one hundred kilograms, preferably less than ten kilograms and, most preferably, about five kilograms. The erosion control mat (14) weighs preferably at least three kilograms.

Anchor systems (12) are provided both above and below the waterline (22). The erosion control mats (14) can be secured in a non-overlapping, or any desired configuration. If the erosion control mats (14) are overlapped, the anchor systems (12) may extend through two erosion control mats (14), tying them together. The anchor systems (12) secure the erosion control mats (14) to the flexible erosion control surface (18) and to the shoreline (16).

Figure 2:
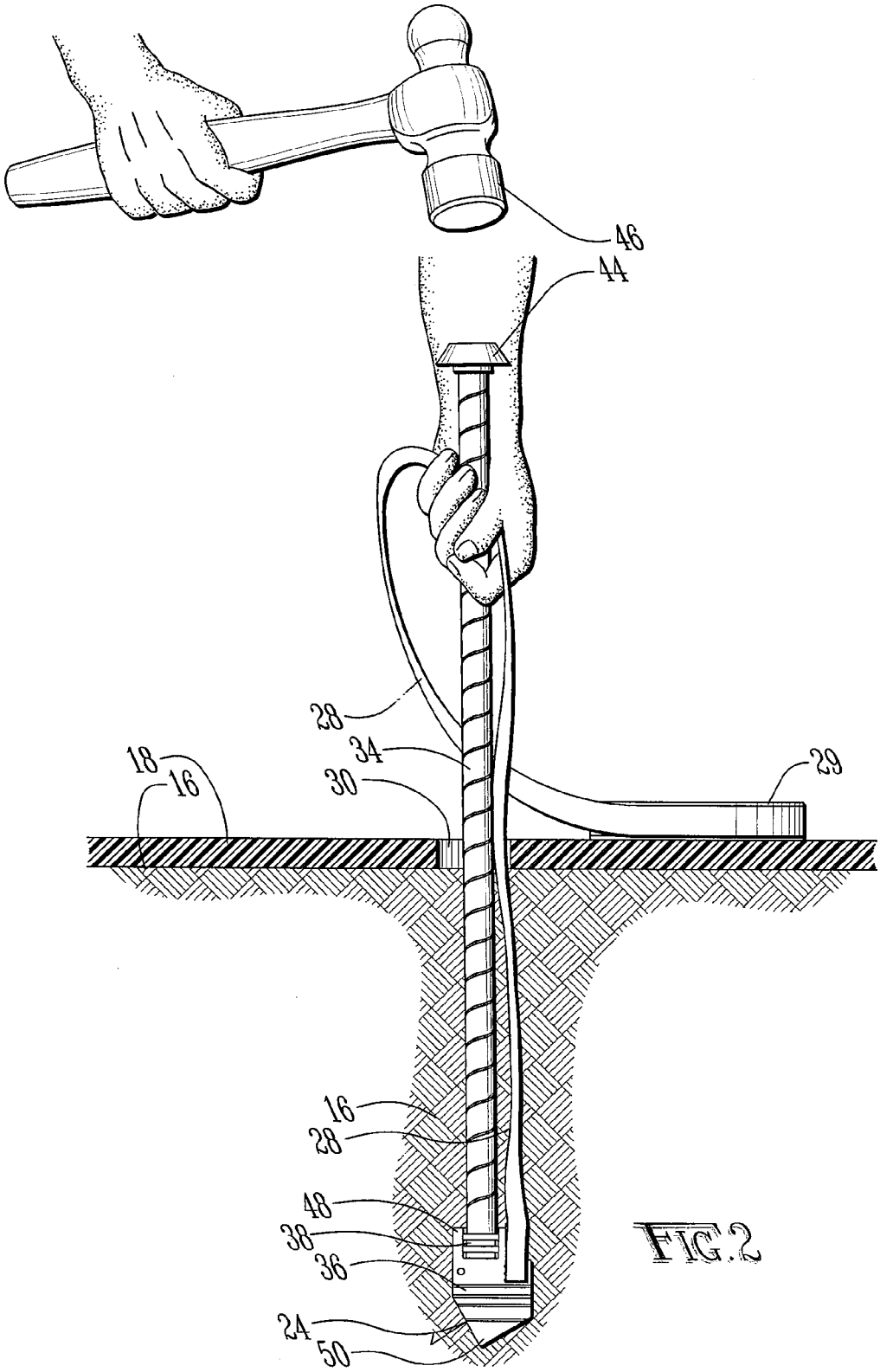
FIG. 2 illustrates a side elevation in partial cross-section of the driving rod positioning the anchor below the ground.

As shown in FIG. 2, the anchor system (12) includes an anchor (26) coupled to a line such as a strap (28) and secured into the shoreline (16). (FIGS. 2 and 3). As shown in FIG. 2, the anchor (26) is preferably stamped from a single sheet of steel to provide a tapered, four-sided structure. The anchor (26) is also preferably provided with holes to allow the anchor (26) to be used in association with prior art cables (not shown) instead of a flat strap (28). While the anchor (26) may be constructed of any desired configuration, the tapered configuration allows the anchor (26) to be easily inserted into the shoreline (16), while reducing damage to the anchor (26) during insertion. Preferably, the anchor (26) is die-cut and bent in a manner known in the art to provide a tapered retaining slot (24), defined by a plurality of ribs (38), to receive the driving rod (34). The slot (24) may be defined by an extra piece secured to the anchor (26), or may be integrally cast into the anchor (26) as desired.

Figure 3A:
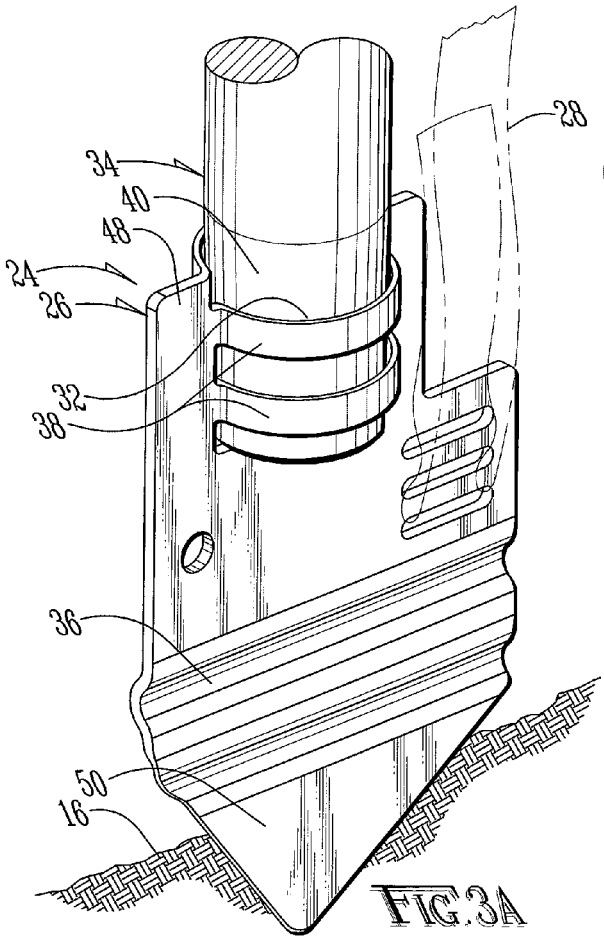
FIGS. 3A-B illustrate side elevations in partial phantom of the anchor system of the present invention.
Figure 3B:
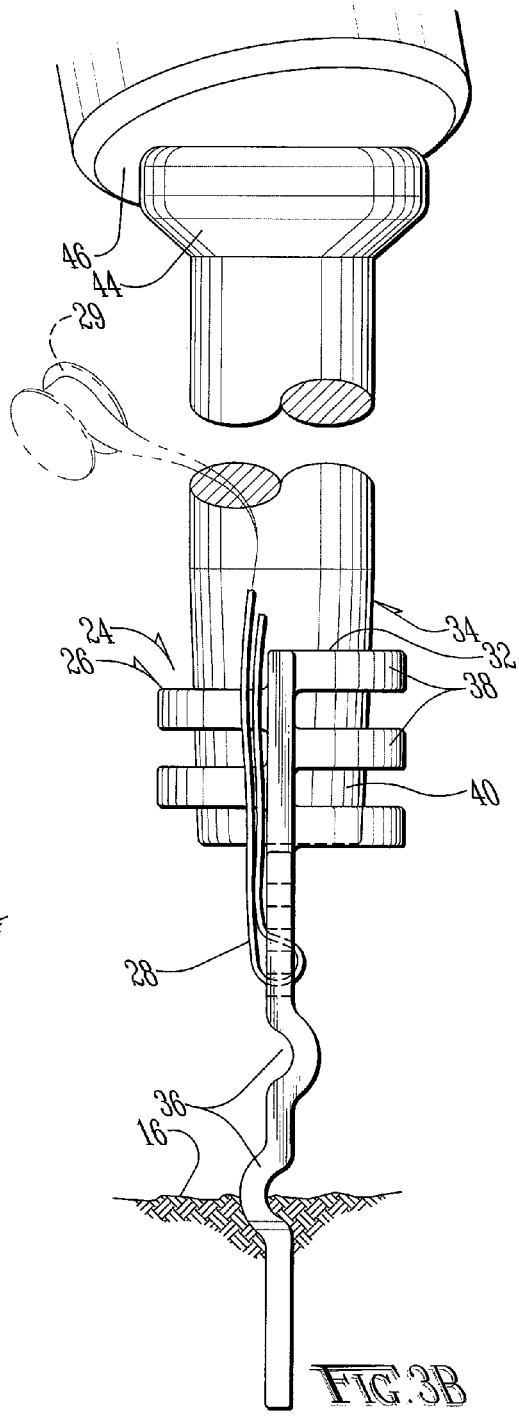

As shown in FIG. 3A-B, the anchor (26) is provided with a plurality of slots (32) to receive the strap (28) which is woven therein. The slots (32) are preferably provided of a size, configuration and orientation so as to lock the strap (28) into place as the anchor (26) is inserted into the shoreline (16) by the driving rod (34). Below the slots (32) the anchor (26) is preferably stamped into a corrugation (36), so as to disrupt the shoreline (16) as the anchor (26) is inserted therein. The corrugation (36) prevents the shoreline (16) from shearing the strap (28) against the sides of the slots (32). The strap (28) is preferably flexible and resilient. In the preferred embodiment, the strap (28) is constructed of woven nylon, fiberglass or any other suitable material known in the art. Preferably, the strap (28) is treated and/or constructed of a material designed to resist degradation associated with ultraviolet radiation, heat, cold and submersion in water, as well as any other elements to which the system (10) is to be subjected.

When it is desired to insert the anchor (26) into the shoreline (16), the driving rod (34) is secured into the slot (24) defined by the ribs (38). FIGS. 2 and 3A-B. The ribs (38) are vertically offset from the slots (32) so that the strap (28) does not interfere with the driving rod (34) during insertion of the anchor (26). Preferably, the driving rod (34) is constructed of steel and provided with a tapered end (40), configured to fit into a mating engagement with the slot (24). The opposite end of the driving rod (34) is preferably provided with a head (44) to provide a striking surface during insertion of the driving rod (34) into the shoreline (16). Once the strap (28) has been woven into the slots (32) of the anchor (26), and the driving rod (34) secured within the slot (24), the erosion control mat (14) is positioned as desired over the flexible erosion control surface (18) and the shoreline (16). Thereafter, the driving rod (34) is used to insert the anchor (26) through one of the holes (30) in the erosion control mat (14) and into the shoreline (16).

Figure 4:
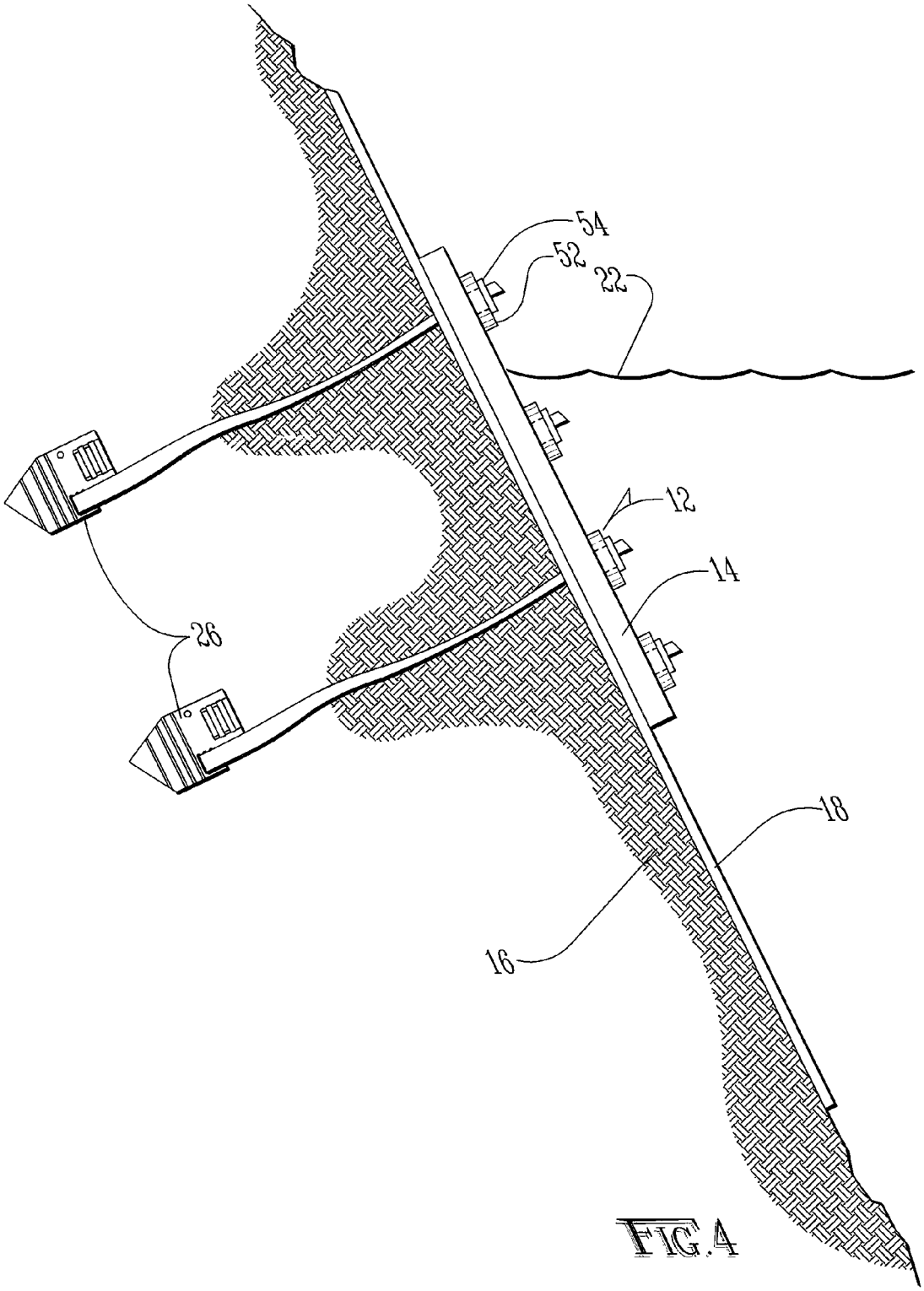
FIG. 4 illustrates a side elevation in cross-section of an alternative embodiment of the present invention, shown secured to a steeply sloped shoreline.

Depending upon the type and slope of shoreline (16) into which the anchor (26) is to be inserted, the driving rod (34) is used to insert the anchor (26) deeper or shallower so as to attain the desired anchoring of the erosion control mat (14) relative to the erosion susceptible surface (14). In very hard or shallowly sloped shoreline (16), the anchor (26) may be inserted shallowly. An alternative deployment, in loose dirt or sand on a steeply sloped shoreline (44), is shown in FIG. 4. In such a deployment, the anchor (26) must be provided more deeply into the shoreline (16) to obtain a similar level of securement. To assist in driving the anchor (26) into the ground, a hammer (46) or the like may be used to strike the driving rod (34) on the head (44). FIG. 2. By utilizing semi-rigid erosion control mats (14) and semi-flexible straps (28), the system (10) gives enough to move with hydrostatic forces, allowing energy equalization on either size of the erosion control mats (14)

Figure 5:
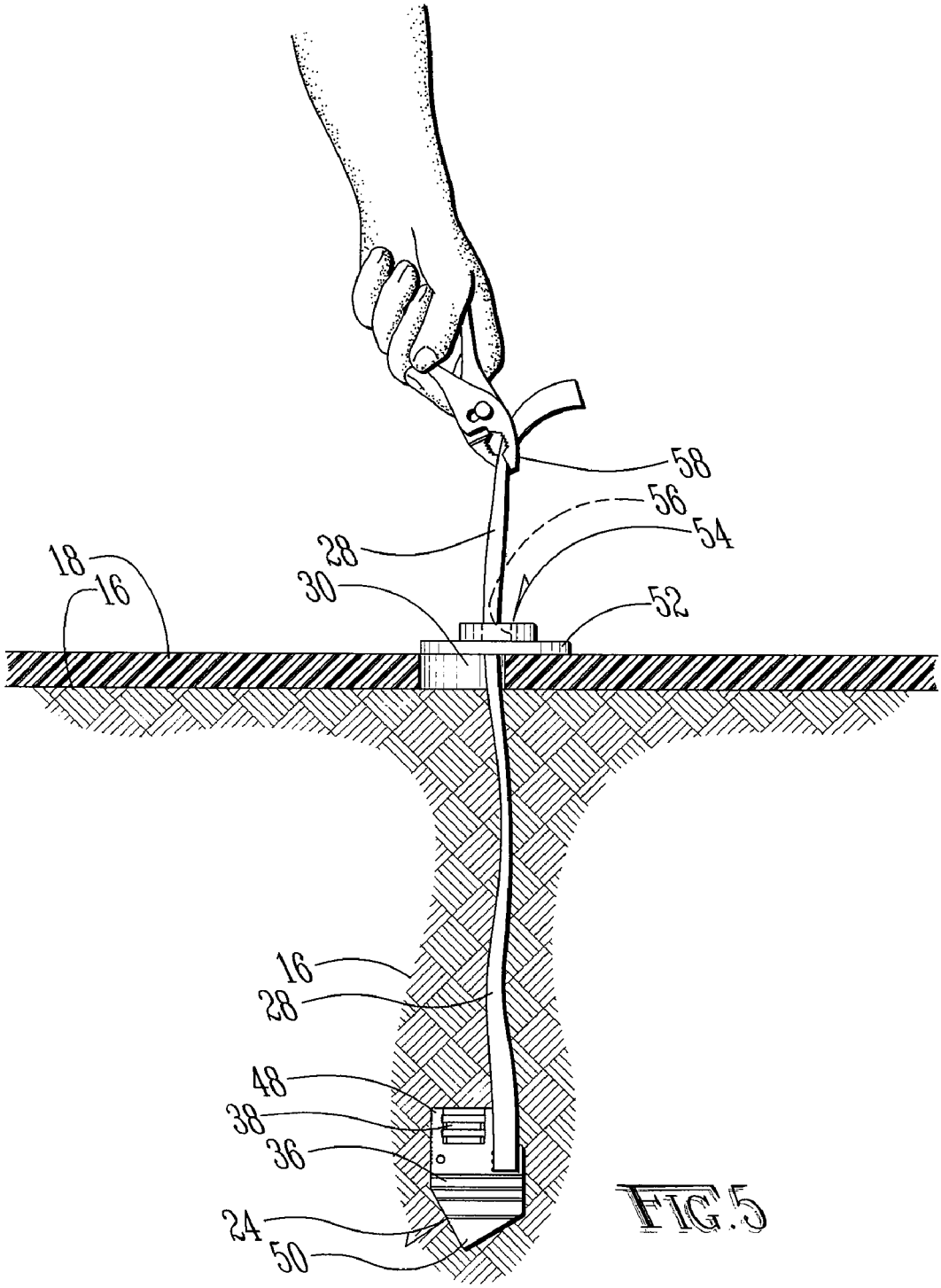
FIG. 5 illustrates a side elevation in cross-section of the erosion control mat of the present invention being anchored to a flexible erosion control surface and a shoreline.

Once the driving rod (34) has been used to drive the anchor (26) to the desired depth, the driving rod (34) is pulled upward. As the top surface (48) of the anchor (26) is provided with a much greater surface area than the bottom (50) of the anchor (26), the anchor (26) inserts easily into the shoreline (16), but resists upward movement of the anchor (26) relative to the shoreline (16). Accordingly, as the driving rod (34) is pulled upward, the tapered end (40) of the driving rod (34) exits the slot (24), leaving the anchor (26) imbedded in the shoreline (16). After the driving rod (34) has been removed, the strap (28) is pulled upward to "set" the anchor (26) in the shoreline (16). Once the anchor (26) has been set, the strap (28) is cut, preferably ten to twenty centimeters above the top of the erosion control mat (14). Thereafter, a washer (52), such as those known in the art, is positioned over the strap (28) and set on the erosion control mat (14). (FIG. 5.) Preferably, the washer (52) is constructed of nylon or other strong weather resistant material and is preferably provided of a diameter greater than the hole (30) through which the strap (28) extends.

A one-way button (54) is then provided over the strap (28) and secured over the washer (52). Preferably, the one-way button (54) is provided of a weather resistant material. The button (54) is provided with an opening (56) having a one-way mechanism, such as those known in the art, to allow the strap (28) to move in a first direction, but which prevents movement of the strap (28) in an opposite direction through the opening (56). To set the button (54) in place, the strap (28) is preferably pulled upward with pliers (58), or the like, while the button (54) is pushed downward. By stretching the strap (28) with the pliers (58), when the button (54) is in place and the pliers (58) released, the resiliency of the strap (28) pulls against the one-way button (54), forcing the erosion control mat (14) into contact with the flexible erosion control surface (18) and the shoreline (16). As shown in FIG. 1, preferably a plurality of anchors (26) is provided as desired to secure the erosion control mats (14) as needed.

The erosion control mats (14) are secured using a plurality of anchors (26) in a manner such as that described above. The erosion control mats (14) may be abutted to one another or they may be shingled in relationship to one another. Preferably, the anchors (26) extend at least five centimeters into the shoreline (16), and are provided in sufficient number and to a sufficient depth into the shoreline (16) to secure the erosion control mats (14) against wave action, shoreline run-off and hydrostatic pressure.

Figure 6:
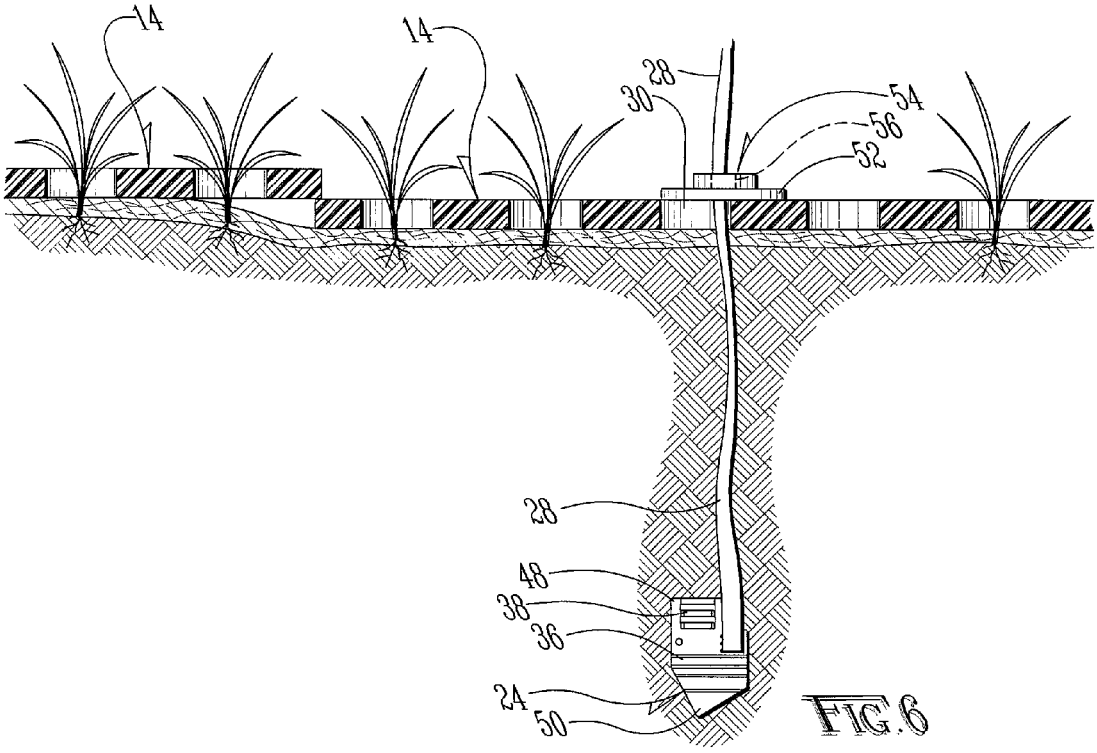
FIG. 6 illustrates a side elevation in cross-section of an alternative embodiment of the present invention, shown with vegetation growing from the shoreline, through a loosely woven erosion control surface and through the erosion control mat.

An alternative embodiment of the present invention is shown generally as (60) in FIG. 6. In this embodiment, a loosely woven flexible erosion control surface is utilized to allow vegetation to grow from the shoreline (16), through the loosely woven flexible erosion control surface and through the erosion control mats (14). The vegetation may be utilized for aesthetic reasons, to further secure the erosion control mats (14), and/or to prevent additional erosion.

The foregoing description and drawings merely explain and illustrate the invention, and the invention is not limited thereto, except insofar as the claims are so limited, as those skilled in the art that have the disclosure before them will be able to make modifications and variations therein without departing from the scope of the invention

The invention claimed is:

1. An erosion control system for reducing shoreline erosion, the erosion control system comprising:

a flexible fabric positioned over at least a portion of a shoreline;

a semi-rigid erosion control mat positioned at least partially over the flexible fabric, wherein the erosion control mat comprises a surface that defines a plurality of holes and is sufficiently rigid to be incapable of rolling onto itself without permanent deformation; and a plurality of anchors, each anchor associated with a tether and a fixture, wherein each anchor is inserted through one of the plurality of holes in the erosion control mat, through the flexible fabric, and into the shoreline, wherein the tether is coupled to the anchor at a first end and to the fixture at a second end, and the fixture is configured to interact with a top surface of the erosion control mat to obstruct the passage of the fixture through the hole in the erosion control mat, and wherein the plurality of anchors secure the erosion control mat and the flexible fabric to the shoreline;

wherein the erosion control system has sufficient rigidity to resist erosion of soil particles of the shoreline due to inflow and outflow of water.

2. An erosion control system for reducing shoreline erosion, said erosion control system comprising:

a flexible fabric positioned over at least a portion of a shoreline;

a semi-rigid erosion control mat positioned at least partially over the flexible fabric, wherein the erosion control mat comprises a surface that defines a plurality of holes, and wherein a two meter long erosion control mat having a first end supported in a plane perpendicular to the force of gravity has sufficient rigidity to resist deflection of a second opposite end of more than forty-five degrees from the plane; and a plurality of anchors, each anchor associated with a tether and a fixture, wherein each anchor is inserted through one of the plurality of holes in the erosion control mat, through the flexible fabric, and into the shoreline, wherein the tether is coupled to the anchor at a first end and to the fixture at a second end, and the fixture is configured to interact with a top surface of the erosion control mat to obstruct the passage of the fixture through the hole in the erosion control mat, and wherein the plurality of anchors secure the erosion control mat and the flexible fabric to the shoreline;

wherein the erosion control system has sufficient rigidity to resist erosion of soil particles of the shoreline due to inflow and outflow of water.

3. An erosion control system for reducing shoreline erosion, said erosion control system comprising:

a flexible fabric positioned over at least a portion of a shoreline;

a semi-rigid erosion control mat positioned at least partially over the flexible fabric, wherein the erosion control mat comprises a surface that defines a plurality of holes, is sufficiently rigid to be incapable of rolling onto itself without permanent deformation, and is sufficiently resilient to at least partially conform to the shoreline; and a plurality of anchors, each anchor associated with a tether and a fixture, wherein each anchor is inserted through one of the plurality of holes in the erosion control mat, through the flexible fabric, and into the shoreline, wherein the tether attaches to the anchor at a first end and to the fixture at a second end, and the fixture is configured to interact with a top surface of the erosion control mat to obstruct the passage of the fixture through the hole in the erosion control mat, and wherein the plurality of anchors secure the erosion control mat and the flexible fabric to the shoreline;

wherein the erosion control system has sufficient rigidity to resist erosion of soil particles of the shoreline due to inflow and outflow of water.

4. A shoreline erosion control system comprising:

a flexible fabric positioned over at least a portion of a shoreline;

a semi-rigid, lightweight, erosion control mat positioned at least partially over the fabric, wherein the erosion control mat comprises a non-woven surface that defines a plurality of holes, is sufficiently rigid to be incapable of rolling onto itself without permanent deformation, and is sufficiently resilient to at least partially conform to the shoreline; and a plurality of anchors, each anchor associated with a tether and a fixture, wherein each anchor is inserted through one of the plurality of holes in the erosion control mat, through the flexible fabric, and into the shoreline, wherein the tether attaches to the anchor at a first end and to the fixture at a second end, and the fixture is configured to interact with a top surface of the erosion control mat to obstruct the passage of the fixture through the hole in the erosion control mat, and wherein the plurality of anchors secure the erosion control mat and the flexible fabric to the shoreline, wherein the shoreline erosion control system is installable on the shoreline by two or less operators and without heavy equipment, and wherein the shoreline erosion control system is safe for contact by watercraft on the shoreline.

5. A method for reducing the erosion of a shoreline, the method comprising:

providing a flexible fabric over at least a portion of a shoreline;

positioning a semi-rigid erosion control mat on the shoreline at least partially overlapping the flexible fabric, the erosion control mat comprising a surface that defines a plurality of holes and having sufficient rigidity to be incapable of rolling onto itself without permanent deformation;

inserting an anchor in one of the plurality of holes in the erosion control mat, the anchor coupled to a first end of a line;

driving the anchor through the hole in erosion control mat, through the flexible fabric, and to a predetermined depth in the shoreline using a driving rod removeably coupled at a first end to the anchor and a hand tool for striking a second end of the driving rod;

removing the first end of the driving rod from a coupling with the anchor;

tensioning the line using one or more of a hand and a hand tool;

retaining the tension in the line with a fixture coupled to the line, the fixture biased by the tension against a surface of the erosion control mat to thereby retain the erosion control mat and the flexible fabric against the shoreline.

* * * * *